US005367364A

United States Patent [19]

Michlin et al.

[11] Patent Number: 5,367,364

[45] Date of Patent: Nov. 22, 1994

[54] CHARGE ROLLER CONTACT STABILIZER SPRING

[75] Inventors: Steven B. Michlin, 5310 Bentley, Ste. 105, West Bloomfield, Mich. 48322; Jeffrey B. Graber, West Hills, Calif.

[73] Assignee: Steven B. Michlin, West Bloomfield, Mich.

[21] Appl. No.: 63,294

[22] Filed: May 19, 1993

[51] Int. Cl.[5] ..... G03G 15/02

[52] U.S. Cl. ..... 355/219; 355/210; 361/221

[58] Field of Search ..... 355/219, 210, 200; 118/661; 361/220, 221; 492/15, 22, 47; 226/190

[56] References Cited

U.S. PATENT DOCUMENTS

| | | | |
|---|---|---|---|
| 4,468,073 | 8/1984 | Machcinski | 339/74 R |
| 4,851,960 | 7/1989 | Nakamura et al. | 361/225 |
| 4,944,915 | 7/1990 | Kim et al. | 420/479 |
| 5,028,966 | 7/1991 | Kozuka et al. | 355/210 X |
| 5,049,944 | 9/1991 | DeBolt et al. | 355/284 |
| 5,095,335 | 3/1992 | Watanabe et al. | 355/210 |
| 5,126,913 | 6/1992 | Araya et al. | 355/219 X |
| 5,148,226 | 9/1992 | Setoriyama et al. | 355/290 |
| 5,283,619 | 2/1994 | Nomura et al. | 355/219 X |

*Primary Examiner*—A. T. Grimley
*Assistant Examiner*—Nestor R. Ramirez

[57] ABSTRACT

A spring-contact device which prevents the primary charge roller of a toner cartridge assembly from shifting back and forth and aids in providing the roller with an electrostatic charge. The device is made from a thin piece of electrically conductive material and comprises a long portion and a short portion bent from the long portion at an approximately right angle. The short portion has a hole in it for fitting over the hub on the charge roller mount in the toner cartridge assembly. The long portion presses against an endpost of the roller, maintaining a spring-contact. A spring-contact device is placed at each end of the charge roller such that the roller is held between the long portions of the spring-contact device by opposing forces. On the side of the cartridge assembly through which the charge is provided, the short portion of the spring-contact device is pressed against the conductive plate on the charge roller mount, thereby providing a charge to the roller from the conductive plate to the endpost of the roller. On the side of the cartridge assembly opposite the side through which the charge is provided, the spring-contact device is coated with an insulated material.

20 Claims, 3 Drawing Sheets

CHARGE ROLLER CONTACT STABILIZER SPRING

BACKGROUND OF THE INVENTION

There has been a recent change in the contemporary technology in dry toner laser printers, copiers and facsimile machines. The old corolla assemblies with their generated high ozone emission levels and high frequency of corona related streaks are largely being replaced with charge roller assemblies. With this recent shift in technology, many unsolved problems have been cropping up, particularly with the first versions, particularly the CANON NX engine as used in the very popular HP LASERJET IIISi and the CANON LX engine as used in the HP LASERJET IIP, IIIP and CANON L-700 series facsimile machines. These problems occur particularly in the laser cartridge remanufacturing industry where these toner cartridges are currently becoming very popular. Among the problems largely reported by these "remanufacturers" as they are sometimes called are grey background haze, reverse double imaging related to the fuser roller, normal double-imaging caused by the primary charge roller (PCR) charge roller aging and degradation, and charge roller contact problems. Many toner cartridges recently available on the market experience the outlined problems to varying degrees. Also, with most cartridges, a reported white powder electrostatically sticks to the primary charge roller or PCR, causing more problems at the end of the recharge cycle when the toner cartridge is near empty and needs to be remanufactured, leaving a white residue on the PCR.

Another problem is the instability of the primary charge roller's physical location as it rotates. The PCR rotates in two saddles and may shift position along its longitudinal centerline, causing a less smooth electrostatic charge and hampering the quality of the image. The instability of the charge roller's physical location also causes increased wear of the saddles after continued use and many cycles, allowing the PCR to also wobble front to back in the saddles. One of the plastic saddles is electrically conductive and does not function as well as it should in helping to transfer the electrostatic charge from the PCR to the photoreceptor drum.

One solution to this problem commonly used by the remanufacturers is to put a conductive grease in the end-saddle for better electrical flow and improved lubrication causing slower wear. This has been an improvement, but has not eliminated the electrical problems experienced. Part of the problem is that the charging of the photoreceptor by the PCR is poor. Another part of the problem is that the erasure of the previous image on the photoreceptor drum, in which the PCR is in contact, is incomplete as a result of the lack of a better electrical connection of the PCR that thereby charges the photoreceptor drum with an incomplete charge. This causes a "ghosting" or double-imaging on the output page. Ghosting is when a part of the previous image or a "ghost" of the previous image appears one or more drum rotations later, and has interfered with the current image. In this case the ghosting is caused by improper erasure of the previous image which stays residually on the photoreceptor drum caused by poor charging of the photoreceptor drum. Also, the PCR must be flush against the photoreceptor drum. If the PCR moves, it can cause more print quality problems.

It should be disclosed that after the invention disclosed in this application was made, the new HP SERIER 4 printer came out with a device in the toner cartridge assembly which attempted to make the location of the PCR more stable by reducing the described wobble. The invention of this application was invented long before the HP version, yet within one year of the filing date of this application. Furthermore, the HP version does not use a flat-spring-contact device at each end of the charge roller. The device used by HP is shaped like a double prong and used at only one end of the charge roller. One HP device (CANON NX printer engine) is made of an alloy that appears to be stainless steel, so it does not improve the electricity flow to the PCR as much. The HP version is believed to be far inferior to this invention. The HP version uses metal at one end and a plastic stop which is a part of the plastic assembly, not modular, at the other. With a plastic non-modular stop at one end, the life of the toner cartridge is limited so more brand-new toner cartridges will be used. With the device of this invention, a clip is used at each end, so if the clips wear, they may be replaced indefinitely for a toner cartridge that may be repaired as long as the other components are usable. With the HP clips, the clip is continuous with the contact strip to the printer, where the cartridge connects electrically to the printer, as one component. With the device of this invention, the clips were designed to be added on for toner cartridges that do not have clips already as an add-on. An improved toner cartridge may now be made as a result, with longer life and may be recycled. The differences between the invention of this application and the HP version will be made clear from the Complete Description. Furthermore, the device of this invention was designed as an "add on" to improve an existing laser printer cartridge lacking in this device, wheras the HP device is one that goes in the brand new cartridge. That is not to say that this device can't go into a brand new cartridge because it may universally go into either.

SUMMARY OF THE INVENTION

The device of this invention is a conductive spring-contact that stabilizes the charge roller and provides significantly improved electrical contact. It presses against each end of the PCR. However, only one end has electrical contact. The improved contact helps the erasure process of the previous image, by charging over the residual image that Otherwise would cause "ghosting" Also, with this conductive spring-contact device, the photoreceptor drum will be charged much better and will therefore have a much better image and print-quality. However, the device would still function well if only the conductive end used the spring-contact device. However, in so doing, the plastic stop built into the PCR assembly frame would eventually wear, so by putting a clip at each end, longer life is possible of the PCR assembly and therefore, of the recycled toner cartridge.

The spring-contact device, when put in place, will prevent the PCR from shifting left to right and right to left (along its longitudinal centerline). It prevents this motion of the PCR in the saddles by pushing against the endposts of the PCR with a spring force. The endposts of the PCR often consist of a metal shaft that runs through the center of the PCR for its entire length and a little bit longer. By pressing against the rotating endposts, the spring-contact device of this invention provides a more consistent and stronger electrical contact to the PCR so it can function better at charging the photoreceptor. This important improvement can cause better erasure of the previous image as well as better charging of the photoreceptor drum. Prior to this invention, the PCR was supplied electricity solely by the plastic conductive saddle on one end of the PCR.

Accordingly, it is an object of this invention to make the position of the primary charge roller in the toner cartridge assembly more stable.

Another object of this invention is to improve the electrical connection from the electrical source to the PCR and decrease the electrical resistance.

A further object of this invention is to provide an improved and replacable coil-spring to the saddle in the PCR mount. This improved coil-spring would assist in keeping the PCR in a fixed position, and would also make the electrical connection more efficient.

As a result of the improvement of this invention the double imaging problem of the imperfect erasure goes away. The double imaging problem or "ghosting", is a serious problem that plagues the early version of the PCR laser printers that have replaced those using corona wires. As a result of this improvement, a major problem in this relatively new family of xerographic/-printing devices using charge rollers has been solved. Now it is practical to use charge rollers.

BRIEF DESCRIPTION OF THE DRAWINGS

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
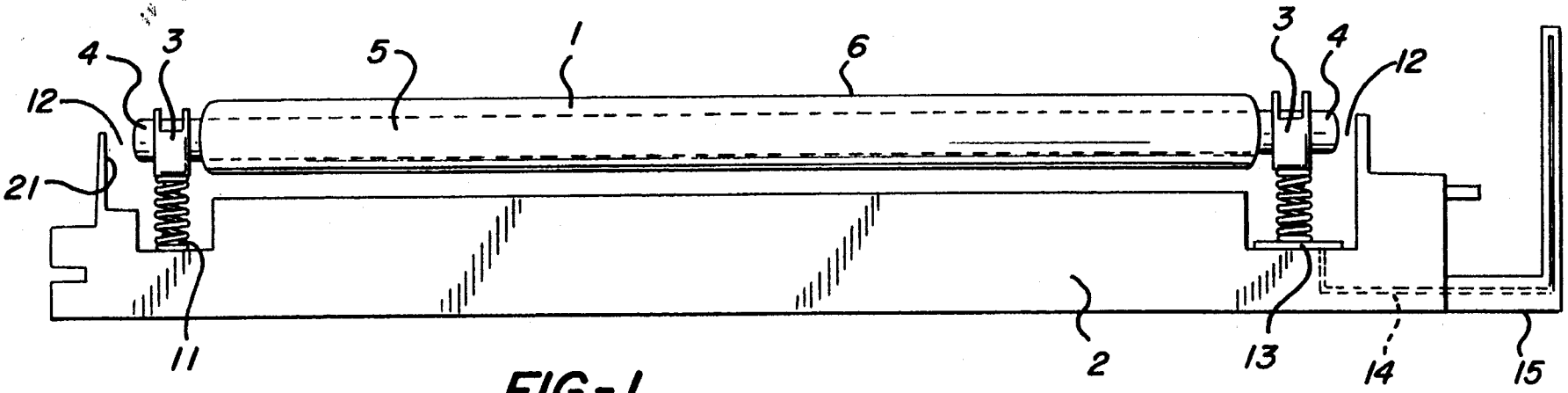
FIG-1 (PRIOR ART)
FIG. 1 shows a conventional charge roller mounting.

FIG. 1 shows a conventional primary charge roller (PCR) and PCR 1 mount 2. The mount 2 fits into a toner cartridge assembly for use in copiers, printers and facsimile machines, although in some machines, the PCR mount may fit directly in the machine rather than in a toner cartridge. The mount 2 includes saddles 3 for receiving the endposts 4 at each end of the PCR 1. The endposts 4 of the PCR are often the actual end of a metal shaft 5 that runs through the center of the PCR for the roller's entire length and beyond. The charge portion 6 of the PCR is mounted on the metal shaft 5.

Figure 2:
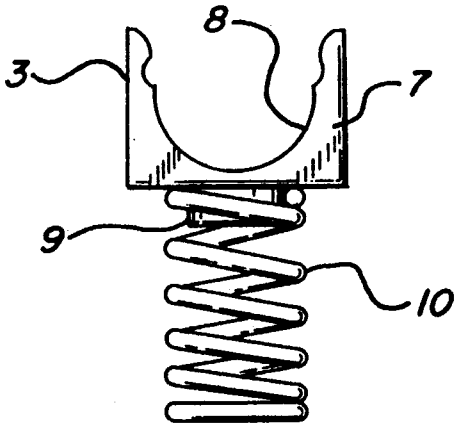
FIG-2 (PRIOR ART)
FIG. 2 is an enlarged view of the conventional saddle for receiving the endpost of the charge roller.

The PCR 1 is held in the mount 2 by the saddles 3. The mount 2 is located in the toner cartridge assembly. The saddles 3 are better shown in FIG. 2. The saddles 3 include a plastic piece 7 with a half-circular reception portion 8 and a nub or protuberance 9. The coil-spring 10 fits over the nub 9 and over an additional hub 11 on each end of the mount 2. A support (not shown) steadies each saddle 3 in the mount 2. The half-circular reception portions 8 receive the endposts 4 of the PCR 1.

There is a clearance space 12 between the PCR mount 2 and each endpost 4 of the PCR so the PCR may rotate freely. One of the saddles 3 is connected to a conductive material, often a flat copper plate or contact 13, by the coil-spring 10. The plate 13 is connected to a source of electricity by a conductive length of material 14 extending through a PCR assembly arm 15 on the mount 2. The coil-spring 10 conducts electricity from the plate 13 to the plastic conductive saddle piece 7 and then to the PCR endpost 4. The conductive saddle piece 7 on one side of the mount 2, contacts the metal plate 13 and assembly arm 15 with a metal spring 10, and is made of an electrically conductive plastic. The saddle 3 on the opposite side of the mount 2 and PCR 1 is usually made of an insulative plastic material.

In the conventional PCR mount 2 described above, the physical location of the PCR 1 is not stable as the PCR rotates during operation of the copier, printer and facsimile machine. The PCR, which rotates in the saddles 3, may shift position in the longitudinal direction, reducing the quality of the resulting image. Additionally, the saddles 3 wear from continued use and from this position shifting and after many cycles the PCR may also wobble in direction at right angles to its length. By minimizing left to right wobble with this invention, the wear that causes this other wobble may be reduced, thus increasing the life of the saddles.

Another problem is that the conductive plastic saddle 3 at the side of the mount 2 connected to the electrical source through the assembly arm 15 does not function electrically as well as would be desired. The conductive plastic of the saddle 3 on its own has some unwanted electrical resistance and does not provide a good enough electrical connection with the PCR 1 for perfect erasure of the previous image, because it does not allow the PCR to charge the photoreceptor drum as well as it should. The previous image on the photoreceptor is erased by saturating over the previous image on the photoreceptor with electrostatic charge, thus overwriting the image with "white space" or erasing the image. When the previous image is not completely erased or "whited out" with electrostatic charge, a "ghost" of the previous image remains on the photoreceptor which can show up on the output page one or more drum rotations later.

Figure 3:
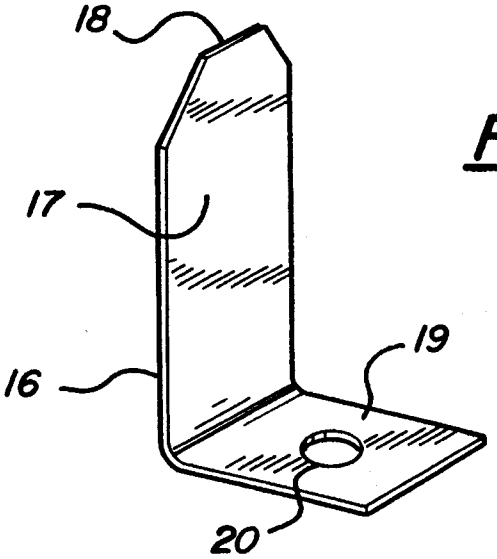
FIG. 3 is an enlarged view of the spring-contact device of this invention.

The invention of this application is designed to overcome the above problems. A spring-contact device 16 is shown in FIG.3. The device consists of a long portion 17. The long portion 17 has an end 18 narrower in width than the long portion. The long portion 17 is tapered to the end 18 as shown. A short portion 19 is bent such that it extends at approximately a right angle from the long portion 17. The short portion 19 has a hole 20 punched or drilled or otherwise formed through it. The spring-contact device 16 is made from a thin, flat piece of carbide, copper, or gold or platinum plated copper, so it is a good conductor of electricity. Gold, platinum, copper, brass, bronze, stainless steel, chrome plated metal, and spring-steel may all be used. A copper alloy with spring properties seems to be the most practical material to use from an economical and production point of view. The alloy is called CDA 510 bronze with a spring temper. The alloy is approximately 95 percent copper and five percent tin and is sometimes known as a phosphorous bronze because it contains traces of phosphorous to improve the material properties. A similar, readily available material is CDA 521 bronze with a spring temper. For even better properties, a beryllium copper alloy such as CDA 172 with a spring temper, often used in telecommunications applications, may be used, but, costs approximately five times as much as the CDA 510 material. For this reason, the increase in material cost using a beryllium alloy does not benefit the product proportional to the increased cost, so the CDA 510 was chosen. In original tests, back in Sep. 9, 1992, a four thousandths of an inch stainless steel alloy was used with great success. In the tests, a thin stainless steel alloy was removed from the paper handling section of a CX printer. It was cut to the appropriate shape, and worked great. Later, another similar device was modified using a beryllium alloy spring copper, also from a paper handling section of a CX printer. The beryllium alloy was found to work optimally. This alloy is often used in components where spring tension and electrical properties are important. Then a phosphorous bronze of 95 percent copper and five percent tin was used called CDA 510 with a spring temper. Initial tests were done with material of twenty thousandths of an inch thick. This was a difficult material because of its spring properties, and in particular, its spring force was too great. Then CDA 510 at ten thousandths of an inch was used. A single-clip design was developed and functioned properly. Conductive grease had to be used to prevent an irritating squeaky sound from being generated. The single-clip design worked fine. It was slightly too tight, however, and this design did not prevent wear on the plastic end 21 of the mount 2. So, a two-clipped design was then made, once again. For the two clipped design the ten thousandths of an inch of CDA 510 had too much frictional resistance between the clip and the shaft, sometimes preventing the PCR 1 from rotating because the spring force was too great. In order to use the two-clip design, it was found that the clip had to be made thinner. At four thousandths of an inch, just like the metal component of the old CX printer, the spring-force is reduced and the PCR 1 is allowed to freely rotate with less frictional resistance. In all the tests, four thousandths of an inch beryllium copper performed the best, however, for economical reasons, CDA 510 with spring temper at four thousandths of an inch thick worked almost as well and was chosen for manufacturing. We may switch again at some time.

Figure 5:
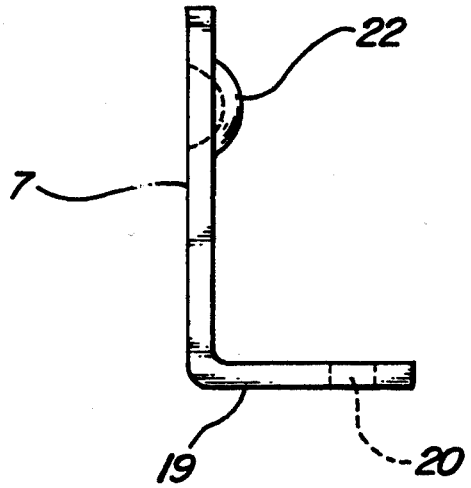
FIG. 5 shows an enlarged side view of a spring-contact including a dimple for reducing contact friction.
Figure 6:
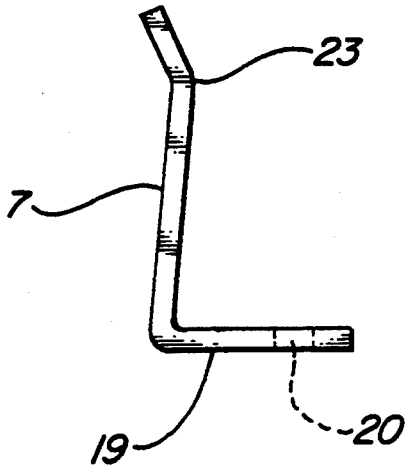
FIG. 6 illustrates the enlarged spring-contact device with a dimple in the form of a bend-line.

Modifications of the spring-contact device 16 may be made. For example, as illustrated in FIG. 5, a dimple 22 may be stamped in the long portion 17 where it touches the PCR endpost. On the nonconductive end this would be desirable to minimize contact. Although maximum contact is desired on the electrical contact end in surface area, punching a dimple in the long portion 17 would minimize friction caused by the device. A smaller contact area between the long portion 17 of the spring-contact device 16 and the PCR endpost 4 generates less friction. The long portion 17 would not interfere as much with the rotation of the PCR 1, but the spring-contact device 16 would still perform its function. In differing operating environments, there can be benefits to each style. For example, when the space is too tight, placing a dimple in the long portion where it contacts the endpost 4 could inadvertantly increase the friction and hamper the operation of the PCR, unless a bend-away would be made. Also, a dimple may be made in the form of a bend-line 23, as shown in the FIG. 6 side view of the spring contact device 16, rather than a "spot". Please also note that the long portion 17 does not have to be tapered as in FIG. 3. It is more economical to manufacture the device with square ends, without cutting the corners. This is how the product will initially be made to lower costs. Other variations may be made to this device that would give it the same effect without preventing it from functioning. Various bends, dimples, and other modifications in the shape of the spring clip 16 may be made, to get similar results, however, at a greater cost.

Figure 4:
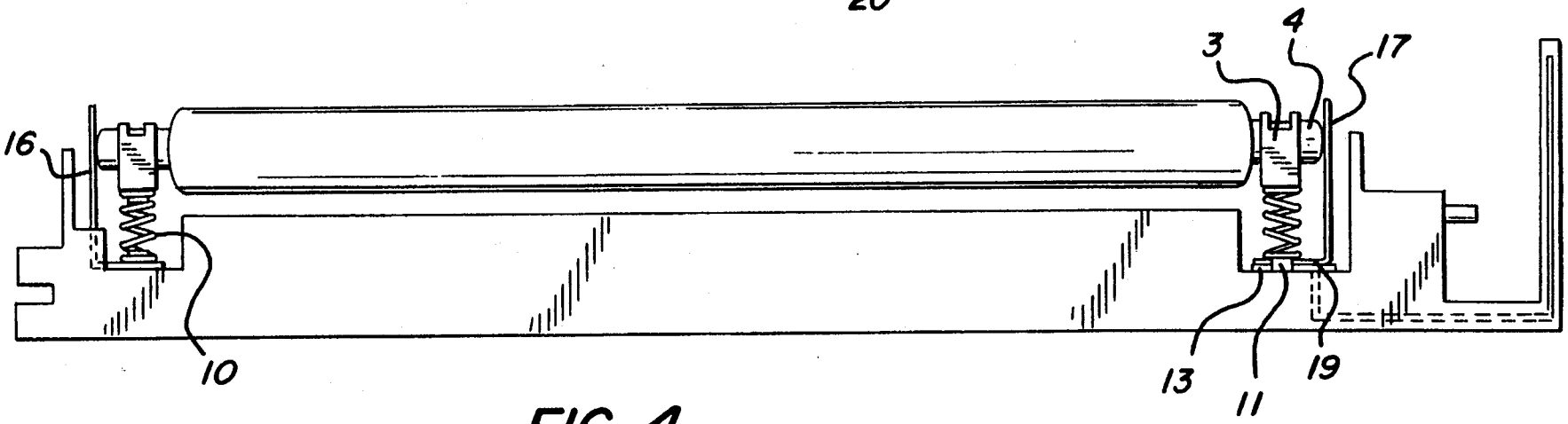
FIG. 4 shows the spring-contact device of this invention as used with the charge roller mounting.

On the electrical connection side of the PCR 1 and mount 2, the short portion 19 of the spring-contact device 16 fits over the nub 11 on the mount 2 by use of the hole 20 in the short portion 19. There is surface-to-surface contact between the short portion 19 of the spring-contact device 16 and the conductive plate 13, as shown in FIG.4. One end of the coil-spring 10 is then fit over the nub 11 as before, so the short portion 19 of the spring-contact device 16 is sandwiched between the end of the coil-spring 10 and the conductive plate 13. The long portion 17 of the spring-contact device 16 extends up past the saddle 3, outward of the saddle, and contacts the endpost 4 of the PCR In actual manufacture, we will initially keep the long portion, 17 shorter than the tallest part of the support of the saddle 3. Otherwise, if the tall portion 17 sticks up too high, it can accidentally scratch or otherwise interfere with the photoreceptor drum 22. It should be pointed out that the way this spring-contact device 16 fits over the nub 11 and is locked in place with the coil spring 10, is a very important innovation of this invention. With this feature, it can be easily fit into place and may be used in PCR mounts 2 that need the spring-contact device 16 in recycled laser toner cartridges that have poor electrical connection.

The same thing is done on the opposite side of the PCR 1 and mount 2, except on this opposite side there is no conductive plate 13. So the spring-contact devices 16, acting on each endpost 4 of the PCR 1, press the charge roller between them. The spring-contact device 16 on the insulative side of the PCR 1 and mount 2 could have a wear-resistant, insulative coating such as urethane applied to it so the spring-contact device 16 won't act as an antenna. In other words, with the coating, the spring-contact device 16 on the insulative side of the PCR 1 and mount 2 won't pick up radio waves that could interfere with the electricity supplied to the PCR through the conductive side of the PCR and mount 2. Just as a dimple may be stamped in the metal, a hole may be drilled through in which a plastic rivet may be used as an insulative dimple. This would be the simplest solution to this problem. However, since the problem has not been noticed in prototype testing, both the dimple and plastic rivot or nub will not be initially implementated in the first production run. This will help keep the costs down.

A serious problem is that there is a poor electrical connection or a resistance between the charge source and the PCR post 4. The reason for this poor connection is not the conductive plastic saddle alone but also the connection between the copper contact plate 13, contacted from the conductive material 14 extending through the PCR assembly arm 15, and the coil-spring 10 that pushes the saddle 3 against the PCR endpost 4. The coil-spring 10 is extremely thin. It makes contact in essentially a very thin circular perimeter. This poor contact is in effect at both ends of the spring 10, one contact against the conductive plastic saddle 3 and the other contact pressing against the copper plate 13 contacted from the conductive material 14 extending through the assembly arm 15. The contacts become poorer with time because as the coil spring 10 ages it tends to lose its spring force capabilities. In other words, with time, the plastic saddle 3 does not press as hard against the end of the spring, and against the PCR endpost 4, reducing the quality of the electrical connection. This inferior contact also causes poorer charging of the photoreceptor drum (not shown) because when the coil-spring 10 loses its spring strength the PCR 1, which in operation presses against the drum and charges it, has poorer contact with the photoreceptor drum. This inferior or incomplete charge causes problems with the quality of machine output because the previous image is not fully removed or charged over from the drum, causing ghosting or double image.

To be precise, it is not that the previous image is not removed or erased. The PCR 1 charges the photoreceptor drum. When the photoreceptor drum does not receive a full charge, part of the residual image leftover from the previous image is not saturated with electrostatic charge. So, in actuality, the erasure is not performed, but the photoreceptor drum receives a new charge over that image, and if not fully saturated, there are cases where the residual previous image remains. So, to the layman, erasure appears not to be performed. However, that is a flaw in the early versions of the PCR based xerography. Rather than use an erase lamp, the image is removed by saturating over the residual previous image, with a full strength electrostatic charge. In other words, the uncharged areas that make up the residual image are intended to be recharged. When electrical contact is poor, as in this early design, the PCR is not always capable of providing a full electrostatic charge to the photoreceptor drum. By using the spring-contact device 16 of this invention the connection is improved so the erasure and charging capabilities are significantly improved and even perfected. Also, as part of this invention, the conventional iron alloy coil-spring 10 may be replaced with a copper alloy coil-spring, or a gold or platinum plated coil-spring to provide a better electrical connection. Although this would help, it would be redundant because the connection will be improved by using the spring-contact device 16. Furthermore, by using a coil-spring 10 with greater spring force or tensile strength, better contact may be maintained between the conductive saddle 3 and the PCR endpost 4, and also, more importantly, better contact may be maintained between the PCR 1 and photoreceptor drum, because when the coil spring 10 weakens, the PCR 1 does not press as hard against the photoreceptor drum, and the photoreceptor drum thus receives a poorer charge from poorer contact against the PCR 1.

Finally, a further improvement in the electrical connection may be made by providing a coil-spring 10 comprised of thicker metal at the head and the tail so there is greater surface to surface contact between the spring 10 and saddle 3, and between the spring 10 and the small portion 19 of the spring-contact device 16 or the copper plate 13. However, when using the spring contact device 16, this improvement would be almost redundant.

It should be pointed out that the flat spring-contact device 16 may be used without using the coil-spring replacement with excellent results. However, there is nothing to lose in doing both improvements simultaneously as a matter of routine maintenance. Once the remanufacturer has removed the saddle 3 to install the flat spring-contact device 16 of this invention, he may simultaneously replace the coil spring 10 with a more practical spring. In any case, after the spring 10 has been used somewhat, it has aged and worn. It may have compressed somewhat and therefore, would need to be replaced. Furthermore, it should be noted that this device may be sold in sets of one pair of flat spring-contacts 16 with one pair of coil-spring contacts 10. This combination may be one product together. This will then fill the needs for a unit PCR upgrade kit. Also, even though one end is not conductive, the same coil-spring should be used at each end so they each have the same force initially, but also because they will both degrade in spring force at approximately the same rate. This will prevent wear of the plastic end of the PCR assembly 2. However, one spring-contact device 16 may be used at the conductive end only, for similar excellent results. When the plastic end of the PCR assembly 2 wears away, two spring-contact devices 16 may later used instead of one.

It is possible that the flat spring-contact component 16 of this invention may have an "antenna effect", as described previously. However, from tests of the device, this has hardly been noticable. It should also be pointed out that prior to this invention, when the photoreceptor drum shifts, the PCR 1 may shift left to right with the drum However, with this invention installed, should the drum shift, the PCR 1 would not shift. By preventing the PCR-shift effect, the drum-shift effect will also be prevented. So, by stabilizing the PCR, one is in effect also stabilizing the photoreceptor drum.

In conclusion, certain prior art toner cartridge assemblies cause gray background, blasting and ghosting problems on the output paper. When the spring-contact device 16 of this invention is used, these problems, particularly the ghosting problem, are minimized and oftentimes prevented. A spring-contact device 16 is used on each side of the PCR 1, preventing wobbling and shifting of the PCR 1. The spring-contact device 16 on the contact side of the mount 2 also increases the quality of the electrical connection and decreases the electrical resistance. These features in combination provide a better output image and reduce wear of the components. When the spring-contact devices 16 are used with the improved coil-springs 10, the electrical connection is improved further and the mounting 2 for the PCR 1 is more stable and resistant to wear and, furtherfore, the PCR presses tightly and evenly against the photoreceptor drum at both ends for a more even electrostatic charge.

It should be pointed out that the shape of the spring-contact device 16 can be modified somewhat and still fulfill the same function. It is hoped that those knowledgable and skilled in the art realize this. The main idea is to maximize electrical connection between the flat plate 13 and the PCR endpost 4. It should be pointed out that no matter what the size and shape of the spring-contact device 16, conductive grease should be used in conjunction with it to provide improved contact and also for lubrication purposes. At the insulative side, normal grease may be used. The grease should be placed where the PCR post 4 contacts the spring-contact device 16.

An interesting phenomenon has been observed when using the spring-contact device 16 in a laser printer cartridge. In prior art mode, without the spring-contact device 16, if there is a gray haze on the output page, the haze may usually be removed by increasing the darkness intensity setting on the laser printer's density dial. This is contrary to what one would expect, however, that is the way it works. On the other hand, when the spring-contact device 16 is used, and gray haze is observed on the output page, decreasing the darkness intensity setting may be used to decrease or remove the haze. This improvement is more in line with the way the darkness intensity dial should work.

In tests, it has been found that when the spring-contact device is manufactured at around an 85 degree angle, it will function best. However, it should be pointed out that to get best results, the clips should be perpendicular to the ends 4 of the PCR. However, in different environments, conditions may differ and other configurations may be optimum.

What is claimed is:

1. A spring-contact means for preventing the shifting in a longitudinal direction of a primary charge roller used in a toner cartridge assembly for copy, printing and facsimile machines, whereby the quality of the image provided by said machines is improved, said spring-contact means being made of a material which aids in the electrical connection and reduces electrical resistance through said toner cartridge assembly to said primary charge roller to allow said charge roller to better perform said charge roller's charging function, said primary charge roller being fixed to a mount which fits onto said toner cartridge assembly, said mount having an end, said end including a nub said primary charge roller having a length extending between two endposts, said spring-contact means comprising a removable modular spring-contact device including a long portion which contacts one of said endposts and a short portion, said short portion having a hole which fits over said nub and attaches said spring-contact device to said mount.

2. A spring-contact means as in claim 1 wherein said long portion of said spring-contact device has a dimple for contacting said one of said endposts of said primary charge roller, whereby friction between said spring-contact device and said primary charge roller is minimized.

3. A spring-contact means as in claim 1 wherein said long portion of said spring-contact device has a bend-line for contacting said one of said endposts of said primary charge roller, whereby friction between said spring-contact device and said primary charge roller is minimized.

4. A spring-contact means for preventing the shifting in a longitudinal direction of a primary charge rollers used in a toner cartridge assembly for copy, printing and facsimile machines, whereby the quality of the image provided by said machines is improved, said spring-contact means comprising first and second spring-contact devices and said primary charge roller having a length extending between two endposts each of said first and second spring-contact devices contacting one of said endposts such that opposing forces are exerted along said length of said primary charge roller by said first and second spring-contact devices, said first spring-contact device being made of a material which aids in the transfer of electricity through said toner cartridge assembly to said primary charge roller, and said second spring-contact device having an insulated coating.

5. A spring-contact means as in claim 4 wherein said insulated coating is urethane.

6. A spring-contact means as in claim 4 wherein said primary charge roller is fixed to a mount and wherein said first and second spring-contact devices each include a long portion which contacts one of said endposts and a short portion fixed by attachment means to said mount, said mount having two ends, each end including a nub, whereby said attachment means of said short portions of said spring-contact devices is a hole in said short portion which fits over said nub.

7. A spring-contact means for preventing the shifting in a longitudinal direction of a primary charge roller used in a toner cartridge assembly for copy, printing and facsimile machines, whereby the quality of the image provided by said machines is improved, said primary charge roller being fixed to a mount which fits onto said toner cartridge assembly, said primary charge roller having a length extending between two endposts, said spring-contact means comprising two spring-contact devices, each of said spring-contact devices including a long portion which contacts one of said endposts and a short portion fixed by attachment means to said mount, such that opposing forces are exerted along said length of said primary charge roller by said spring-contact devices.

8. A spring-contact means as in claim 7 wherein said mount has two ends, each end including a nub, whereby said attachment means of said short portions of said spring-contact devices is a hole in said short portion which fits over said nub.

9. A spring-contact means as in claim 8 wherein said short portions of said spring-contact devices are bent at approximately eighty to ninety degrees from said long portions of said spring-contact devices.

10. A spring-contact means as in claim 9 wherein said long portions of said spring-contact devices are tapered to ends opposite said short portions, said ends of said long portions being narrower in width than the remainder of said long portions.

11. A spring-contact means as in claim 7 wherein one of said spring-contact devices is made of a material which aids in the transfer of electricity from said mount to said primary charge roller.

12. A spring-contact means as in claim 11 wherein said mount includes a conductive plate to which electricity flows, said one of said spring-contact devices being in surface to surface contact with said conductive plate.

13. A spring-contact means as in claim 12 wherein said surface contact between said one of said spring-contact devices and said conductive plate is caused by said short portion of said spring-contact device pressing against said conductive plate.

14. A spring-contact means as in claim 13 wherein said short portion of said one of said spring-contact devices is pressed against said conductive plate by one end of a coil-spring, the other end of said coil-spring being fixed to a conductive saddle which receives one of said endposts of said primary charge roller.

15. A spring-contact means as in claim 14 wherein said coil-spring is made of a material which aids in the conducting of electricity from said conductive plate to said conductive saddle to said primary charge roller.

16. A spring-contact means as in claim 15 wherein said coil-spring material is a copper alloy, or gold or platinum plated copper alloy.

17. A spring-contact means as in claim 16 wherein said coil-spring is provided with larger ends to increase surface contact at said short portion and at said conductive saddle, whereby conductivity from said conductive plate to said primary charge roller is improved.

18. A spring-contact means as in claim 17 wherein said coil-spring is provided with a greater spring force to cause better contact between said conductive saddle and said endpost of said primary charge roller, improving conductivity and the performance of the primary charge roller.

19. A spring-contact means as in claim 7 wherein said long portion of each of said spring-contact devices has a dimple for contacting said one of said endposts of said primary charge roller, whereby friction between said spring-contact devices and said primary charge roller is minimized.

20. A spring-contact means as in claim 7 wherein said long portion of each of said spring-contact devices has a bend-line for contacting said one of said endposts of said primary charge roller, whereby friction between said spring-contact devices and said primary charge roller is minimized.

* * * * *